US007814979B2

(12) United States Patent
Springett et al.

(10) Patent No.: US 7,814,979 B2
(45) Date of Patent: Oct. 19, 2010

(54) BLOWOUT PREVENTERS AND METHODS OF USE

(75) Inventors: Frank Benjamin Springett, Spring, TX (US); James D. Brugman, Spring, TX (US)

(73) Assignee: National Oilwell Varoo, L.P., Houston, TX (US)

( * ) Notice: Subject to any disclaimer, the term of this patent is extended or adjusted under 35 U.S.C. 154(b) by 0 days.

(21) Appl. No.: 12/151,279

(22) Filed: May 5, 2008

(65) Prior Publication Data

US 2008/0286534 A1 Nov. 20, 2008

Related U.S. Application Data

(62) Division of application No. 11/411,203, filed on Apr. 25, 2006, now Pat. No. 7,367,396.

(51) Int. Cl.
*E21B 29/08* (2006.01)
*E21B 29/00* (2006.01)

(52) U.S. Cl. ..... 166/298; 166/55; 83/694

(58) Field of Classification Search ..... 166/298, 166/55; 83/693, 694
See application file for complete search history.

(56) References Cited

U.S. PATENT DOCUMENTS

| | | | | |
|---|---|---|---|---|
| 2,304,793 | A | 12/1942 | Bodine, Jr. | 166/298 |
| 2,592,197 | A | 4/1952 | Schweitzer | |
| 3,040,611 | A | 6/1962 | Tournaire | |
| 3,554,278 | A | 1/1971 | Reistle, III, et al. | 166/85 |
| 3,554,480 | A | 1/1971 | Rowe | 251/1 |
| 3,647,174 | A | 3/1972 | Lerouax | 251/1 |
| 3,670,761 | A | 6/1972 | Lerouax | 137/315 |
| 3,716,068 | A | 2/1973 | Addison | 137/67 |
| 3,766,979 | A | 10/1973 | Petrick | 166/55 |
| 3,863,667 | A | 2/1975 | Ward | 137/318 |
| 3,918,478 | A | 11/1975 | Lerouax | 137/315 |
| 3,955,622 | A | 5/1976 | James | 166/0.5 |
| 4,043,389 | A | 8/1977 | Lobb | 166/55 |
| 4,119,115 | A | 10/1978 | Carruthers | 137/318 |
| 4,132,265 | A | 1/1979 | Williams, Jr. | 166/55 |
| 4,215,749 | A | 8/1980 | Dare et al. | 166/361 |
| 4,253,638 | A | 3/1981 | Troxell, Jr. | 251/1 A |
| 4,341,264 | A | 7/1982 | Cox et al. | 166/55 |
| 4,372,527 | A | 2/1983 | Rosenhauch et al. | 251/1 A |
| 4,437,643 | A | 3/1984 | Brakhage, Jr. et al. | 251/1 A |
| 4,504,037 | A | 3/1985 | Beam et al. | 251/1 |

(Continued)

OTHER PUBLICATIONS

Shear Ram Capabilities Study: West Engineering Services: pages Cover to 4-7 (23 pages); Sep. 2004.

(Continued)

*Primary Examiner*—Shane Bomar
(74) *Attorney, Agent, or Firm*—Victora H. Segura

(57) ABSTRACT

Methods and apparatuses for severing a wellbore tubular, the apparatus, in certain aspects, including: a first member movable toward a tubular to be severed; a second member with a second blade disposed opposite to the first member and movable toward the tubular; a first blade on the first member having a projection projecting from a center of a blade body with point structure on the projection for puncturing the tubular and cutting surfaces on the projection for cutting the tubular; and cutting surfaces, as needed, on the blade body adjacent the projection for cutting the tubular.

13 Claims, 15 Drawing Sheets

U.S. PATENT DOCUMENTS

| | | | | |
|---|---|---|---|---|
| 4,516,598 | A | 5/1985 | Stupak | 137/318 |
| 4,518,144 | A | 5/1985 | Vicic et al. | 251/1 A |
| 4,537,250 | A | 8/1985 | Troxell, Jr. | 166/55 |
| 4,540,046 | A | 9/1985 | Granger et al. | 166/55 |
| 4,550,895 | A | 11/1985 | Shaffer | 251/1.3 |
| 4,558,842 | A | 12/1985 | Peil et al. | 251/1.3 |
| 4,699,350 | A | 10/1987 | Herve | 25/1.3 |
| 4,923,005 | A | 5/1990 | Laky et al. | 166/55 |
| 4,969,390 | A | 11/1990 | Williams, II | 92/28 |
| 5,013,005 | A | 5/1991 | Nance | 251/1.3 |
| 5,217,073 | A | 6/1993 | Bruns | 166/298 |
| 5,360,061 | A | 11/1994 | Womble | 166/55 |
| 5,400,857 | A | 3/1995 | Whitby et al. | 166/297 |
| 5,505,426 | A | 4/1996 | Whitby et al. | 251/1.3 |
| 5,515,916 | A | 5/1996 | Haley | 166/55 |
| 5,575,451 | A | 11/1996 | Colvin et al. | 251/1.3 |
| 5,897,074 | A | 4/1999 | Brugman et al. | 251/1.3 |
| 6,158,505 | A | 12/2000 | Araujo | 166/55 |
| 6,173,770 | B1 | 1/2001 | Morrill | 166/85.4 |
| 6,510,897 | B2 | 1/2003 | Hemphill | 166/373 |
| 6,834,721 | B2 | 12/2004 | Suro | 166/297 |
| 6,843,463 | B1 | 1/2005 | McWhorter et al. | 251/1.1 |
| 6,969,042 | B2 | 11/2005 | Gaydos | 251/1.3 |
| 7,044,430 | B2 | 5/2006 | Brugman et al. | 251/1.1 |
| 7,051,990 | B2 | 5/2006 | Springett et al. | 251/1.1 |
| 7,207,382 | B2 | 4/2007 | Schaeper | 166/55 |
| 7,354,026 | B2 | 4/2008 | Urrutia | 251/1.3 |
| 7,367,396 | B2 * | 5/2008 | Springett et al. | 166/298 |
| 7,410,003 | B2 | 8/2008 | Ravensbergen | 166/384 |
| 2006/0137827 | A1 | 6/2006 | Uneyama et al. | 156/510 |

OTHER PUBLICATIONS

Land & Marine Drilling; Cameron Iron Works Oil Tool division; pages Cover. 1604. 1617. 1621: 1982-1983.

Varco's NXT Next Generation BOP Systems reduce the cost of Drilling: Varco: 6 pages: 2001.

* cited by examiner

FIG. 2A
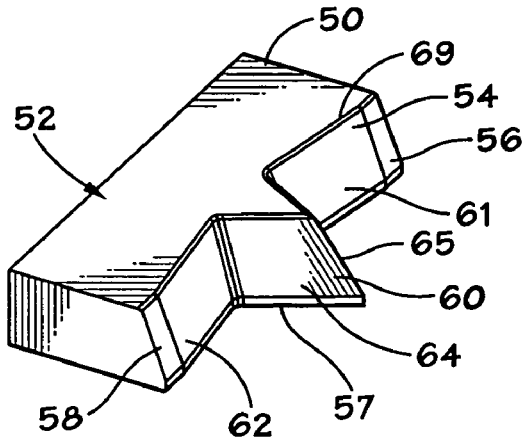
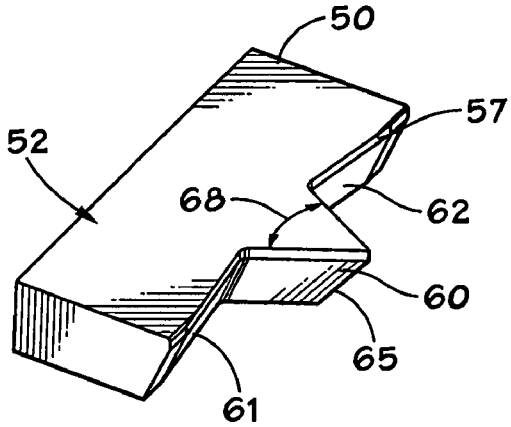
FIG. 2B
FIG. 2C
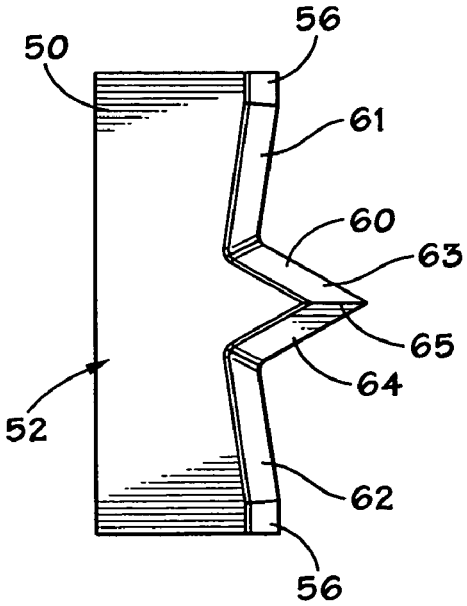
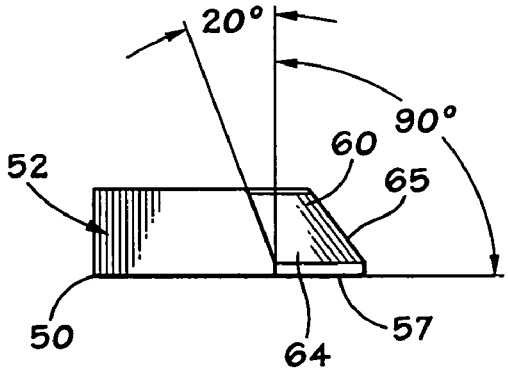
FIG. 2D

FIG. 4A
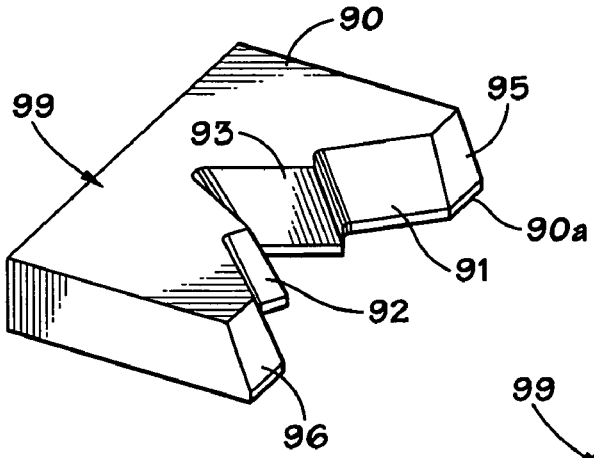
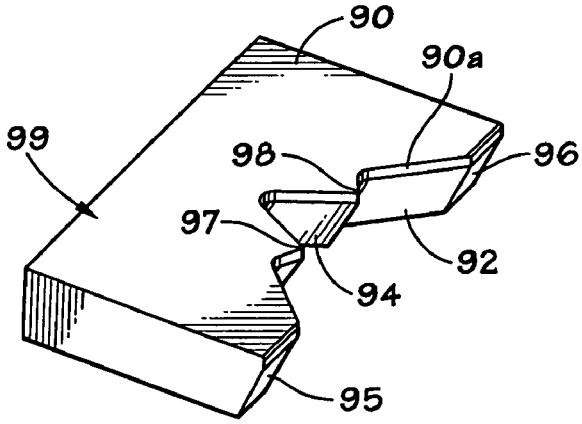
FIG. 4B
FIG. 4C
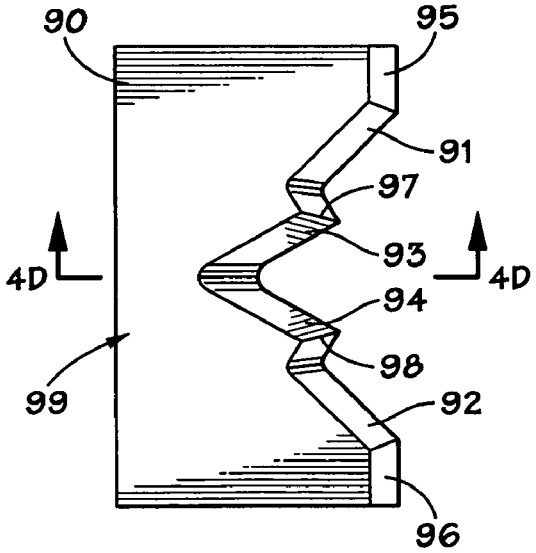
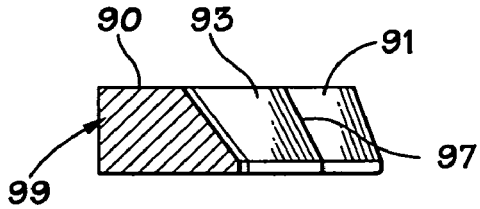
FIG. 4D

FIG. 5A
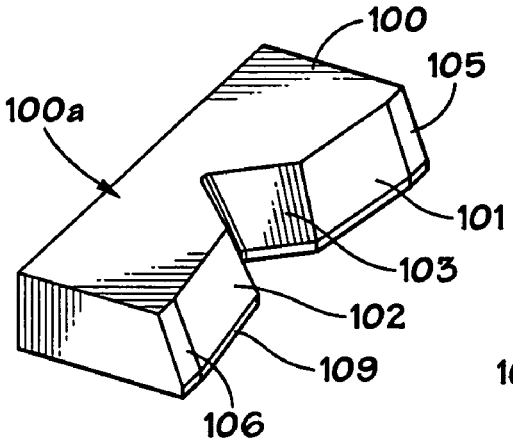
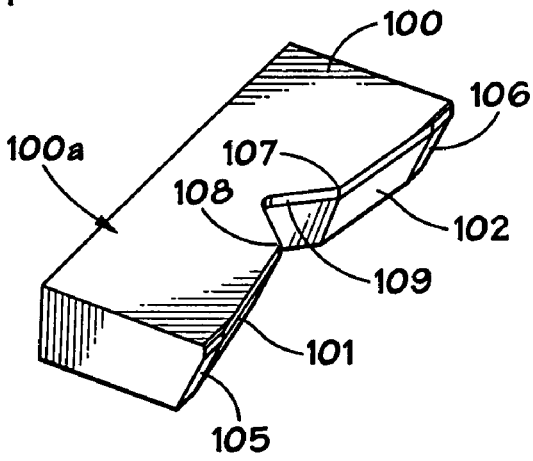
FIG. 5B
FIG. 5C
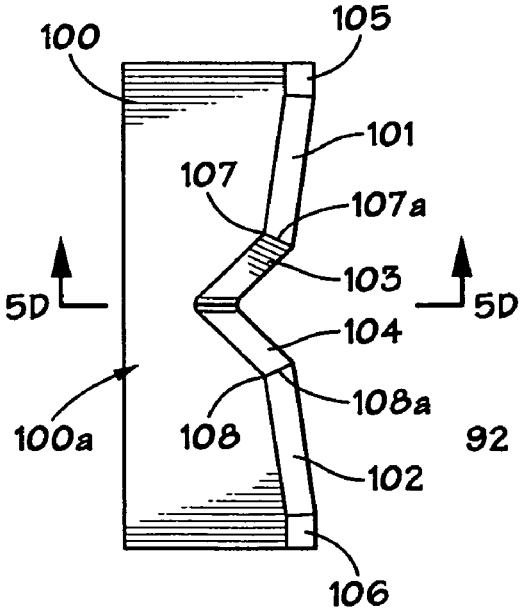
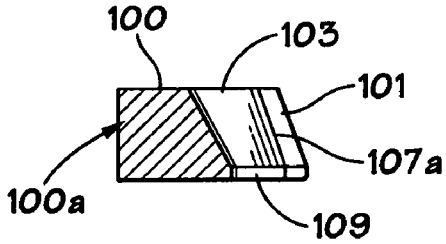
FIG. 5D

FIG. 6A
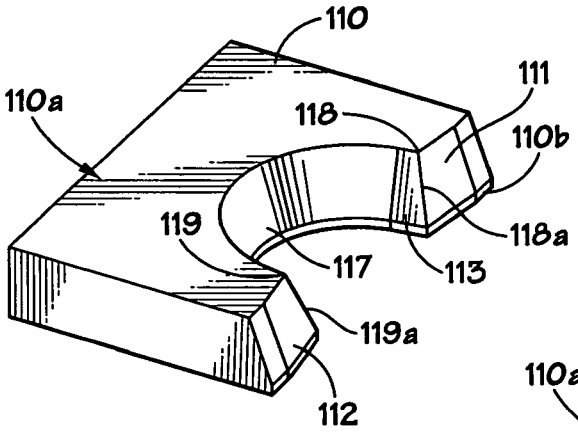
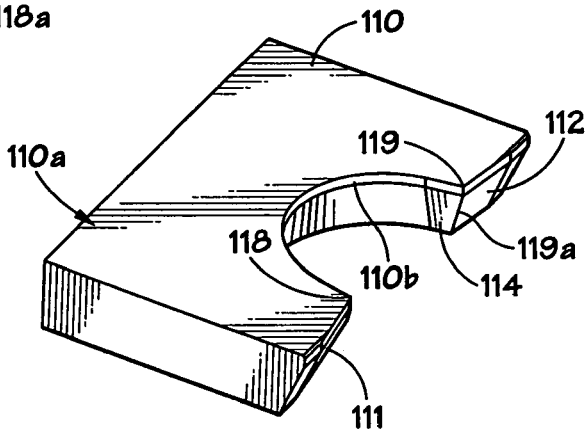
FIG. 6B
FIG. 6C
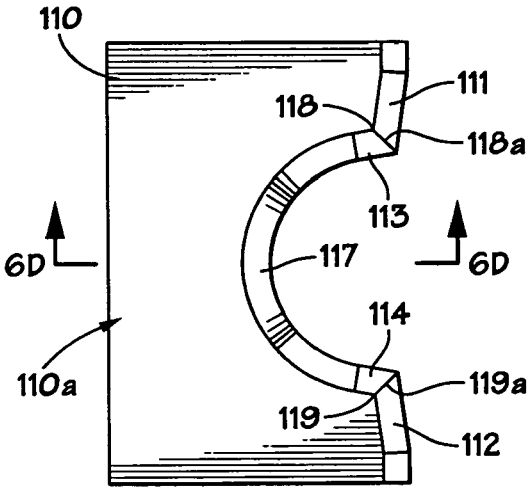
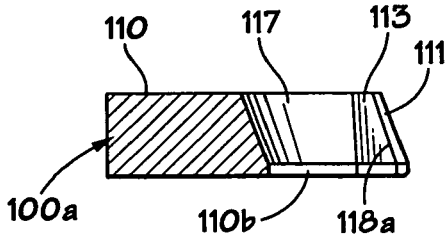
FIG. 6D

FIG. 7A
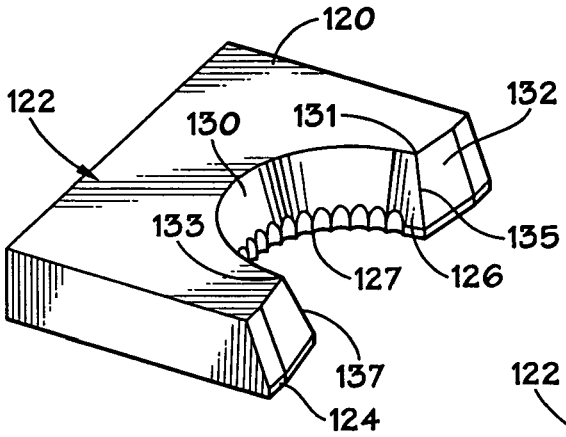
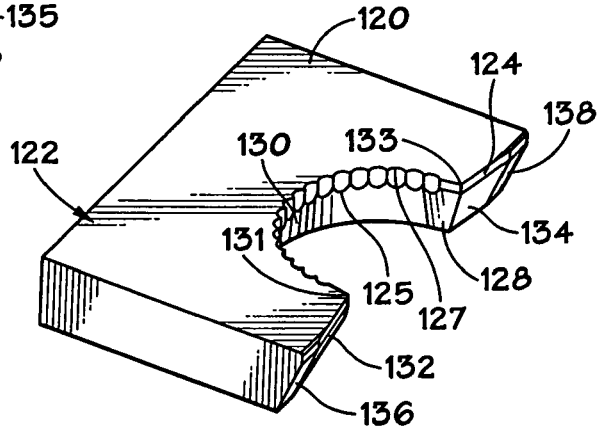
FIG. 7B
FIG. 7C
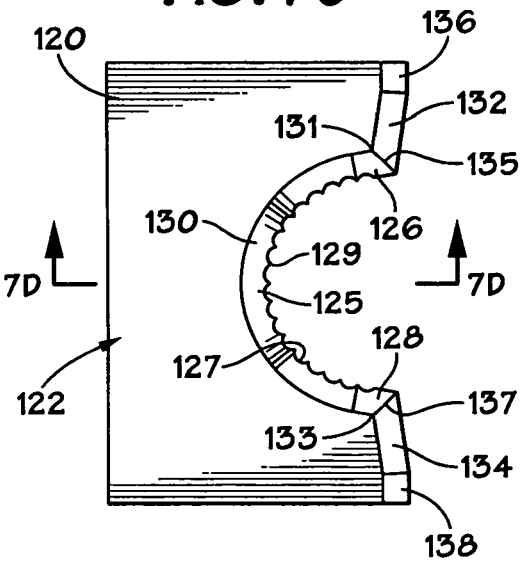
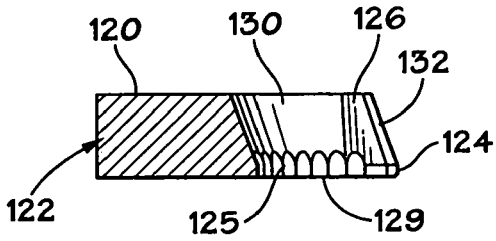
FIG. 7D

FIG. 9A
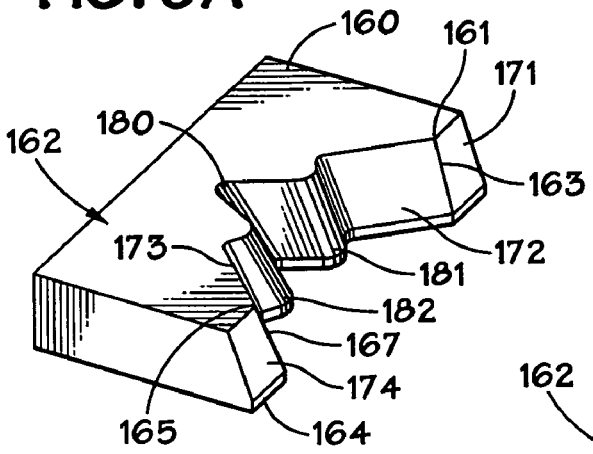
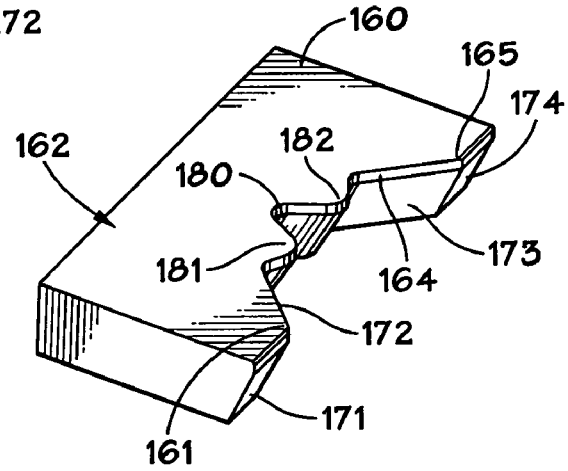
FIG. 9B
FIG. 9C
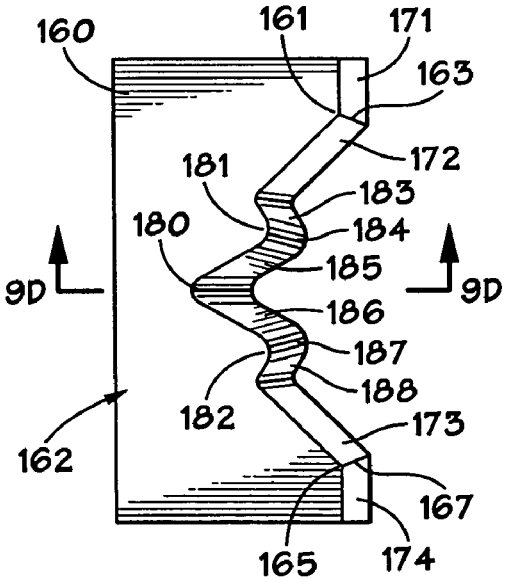
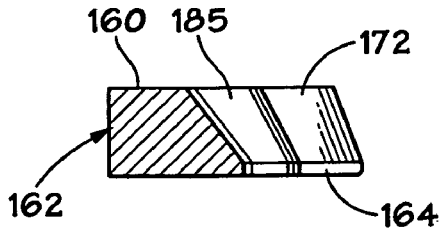
FIG. 9D

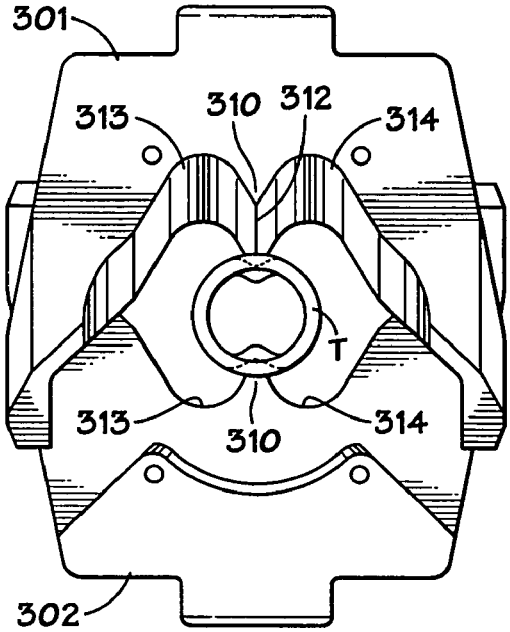
FIG. 15C
FIG. 15D
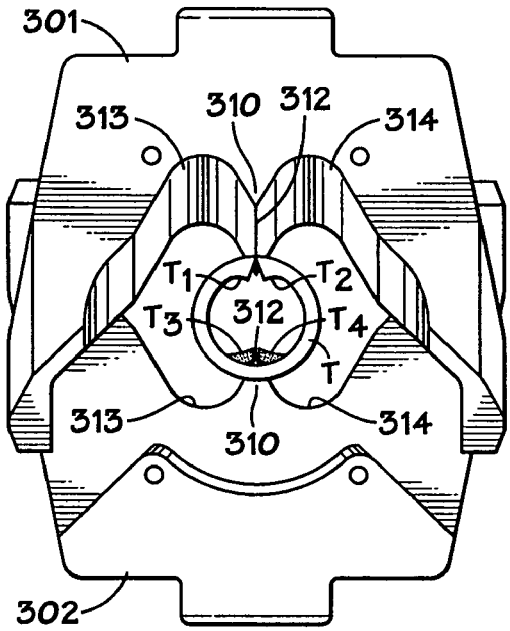
FIG. 15E
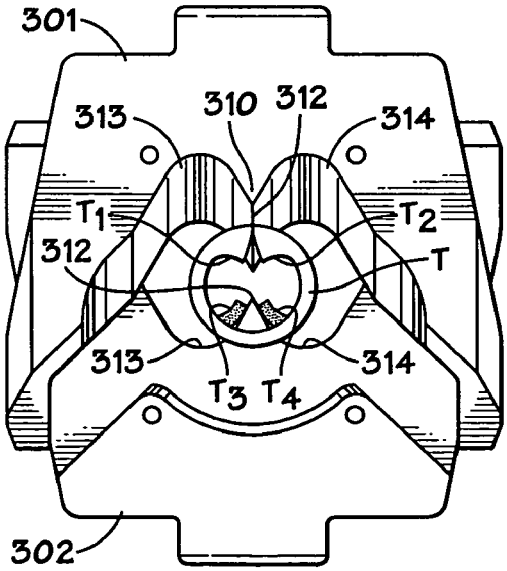

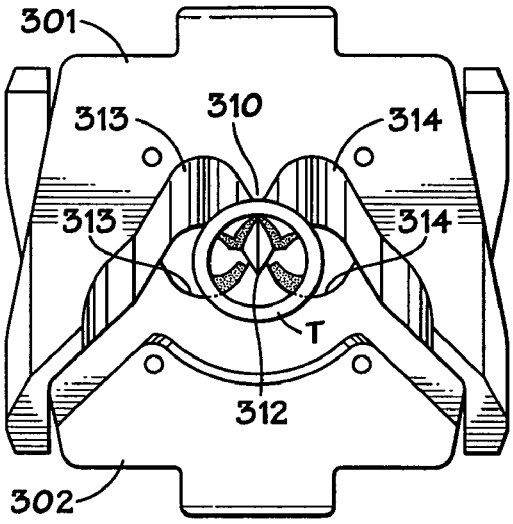
FIG. 15F
FIG. 15G
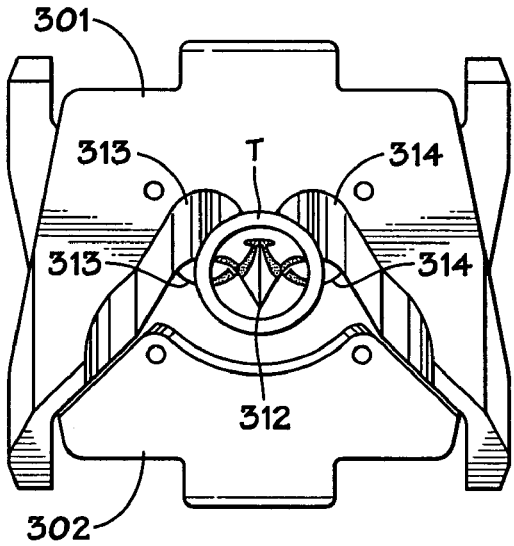
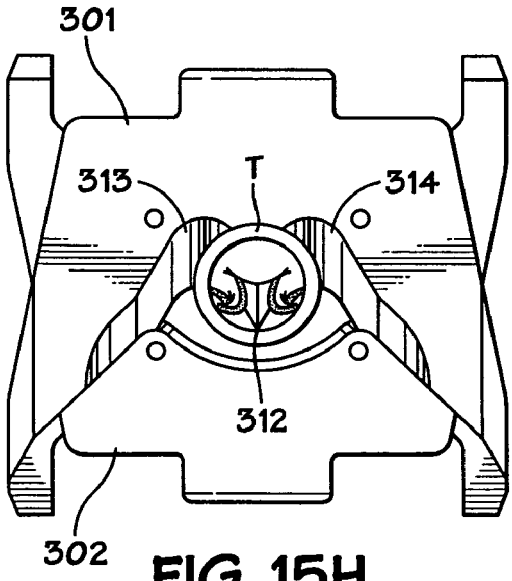
FIG. 15H

BLOWOUT PREVENTERS AND METHODS OF USE

RELATED APPLICATION

This is a division of U.S. application Ser. No. 11/411,203 filed Apr. 25, 2006, issued as U.S. Pat. No. 7,367,396 on May 6, 2008 and from which and under which the present invention and application claim priority under the United States Patent Laws.

BACKGROUND OF THE INVENTION

1. Field of the Invention

This present invention is directed to blowout preventers, to tubular-shearing blades for them, and methods of their use.

2. Description of Related Art

The prior art discloses a wide variety of blowout preventers and tubular-shearing blades for blowout preventer bonnets.

Typical blowout preventers have selectively actuatable rams bonnets secured to the body which are either pipe rams (to contact, engage, and encompass pipe and/or tools to seal a wellbore) or shear rams (to contact and physically shear a tubular, casing, pipe or tool used in wellbore operations). Rams typically upon activation and subsequent shearing of a tubular, seal against each other over a center of a wellbore.

Blowout preventers and tubular-shearing blades for them are disclosed in many U.S. patents, including, but not limited to, U.S. Pat. Nos. 3,946,806; 4,043,389; 4,313,496; 4,132,267, 4,558,842; 4,969,390; 4,492,359; 4,504,037; 2,752,119; 3,272,222; 3,744,749; 4,253,638; 4,523,639; 5,025,708; 5,056,418; 5,400,857; 5,575,452; 5,655,745; and 5,918,851; 4,313,496; 4,550,895; 5,360,061; 4,923,005; 4,537,250; 5,515,916; 6,173,770; 3,863,667; 6,158,505; 5,575,451; 4,057,887; 5,505,426; 3,955,622; 3,554,278; and 5,013,005.

There has long been a need, recognized by the present inventor for a blowout preventer which can effectively and efficiently shear tubulars, e.g. tubulars used in wellbore operations, including relatively large tubulars such as casing, drill collars, and drill pipe tool joints. In certain prior tubular shearing systems, a tool joint is located so that shearing rams do not encounter the tool joint, but shear only a relatively smaller portion of the tubular. Proper location takes time and, if a tool joint is improperly located, no or ineffectual shearing may result.

BRIEF SUMMARY OF THE INVENTION

In one aspect, the present invention discloses a blowout preventer and methods of its use, the blowout preventer having movable ram blocks, one or both of which has a cutting blade that produces one, two, or more holes, openings, or punctures of a tubular as the tubular is sheared to facilitate complete shearing of the tubular.

In certain aspects, the present invention discloses a blowout preventer with a body with a top, a bottom, and a bore therethrough from the top to the bottom; and ram apparatus movable within the body, the ram apparatus including two ram blocks, each with a cutting blade thereon according to the present invention.

In certain aspects, the present invention discloses cutting blades for blowout preventers, each blade with one, two, three or more projections, points or pronounced portions which form an opening hole or puncture area in a tubular to facilitate shearing of the tubular.

It is, therefore, an object of at least certain embodiments of the present invention to provide new, useful, unique, efficient, nonobvious blowout preventers and methods of their use, cutting blades for such blowout preventers, and methods of their use; and Such a blowout preventer with one or two cutting blades, at least one of which has at least one part for making a hole, etc. in a tubular to facilitate shearing of the tubular.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 2A is a top perspective view of a blade according to the present invention for a blowout preventer according to the present invention.

FIG. 2B is a bottom perspective view of the blade of FIG. 2A.

FIG. 2C is a top view of the blade of FIG. 2A.

FIG. 2D is a side view of the blade of FIG. 2A.

FIG. 4A is a top perspective view of a blade according to the present invention for a blowout preventer according to the present invention.

FIG. 4B is a bottom perspective view of the blade of FIG. 4A.

FIG. 4C is a top view of the blade of FIG. 4A.

FIG. 4D is a cross-section view along line 4D-4D of FIG. 4A.

FIG. 5A is a top perspective view of a blade according to the present invention for a blowout preventer according to the present invention.

FIG. 5B is a bottom perspective view of the blade of FIG. 5A.

FIG. 5C is a top view of the blade of FIG. 5A.

FIG. 5D is a cross-section view along line 5D-5D of FIG. 5A.

FIG. 6A is a top perspective view of a blade according to the present invention for a blowout preventer according to the present invention.

FIG. 6B is a bottom perspective view of the blade of FIG. 6A.

FIG. 6C is a top view of the blade of FIG. 6A.

FIG. 6D is a cross-section view along line 6D-6D of FIG. 6A.

FIG. 7A is a top perspective view of a blade according to the present invention for a blowout preventer according to the present invention.

FIG. 7B is a bottom perspective view of the blade of FIG. 7A.

FIG. 7C is a top view of the blade of FIG. 7A.

FIG. 7D is a cross-section view along line 7D-7D of FIG. 7A.

FIG. 9A is a top perspective view of a blade according to the present invention for a blowout preventer according to the present invention.

FIG. 9B is a bottom perspective view of the blade of FIG. 9A.

FIG. 9C is a top view of the blade of FIG. 9A.

FIG. 9D is a cross-section view along line 9D-9D of FIG. 9A.

FIG. 15C is a top view that illustrates a step in a method according to the present invention using apparatus according to the present invention.

FIG. 15D is a top view that illustrates a step in a method according to the present invention using apparatus according to the present invention.

FIG. 15E is a top view that illustrates a step in a method according to the present invention using apparatus according to the present invention.

FIG. 15F is a top view that illustrates a step in a method according to the present invention using apparatus according to the present invention.

FIG. 15G is a top view that illustrates a step in a method according to the present invention using apparatus according to the present invention.

FIG. 15H is a top view that illustrates a step in a method according to the present invention using apparatus according to the present invention.

DETAILED DESCRIPTION OF THE INVENTION

Figure 1A:
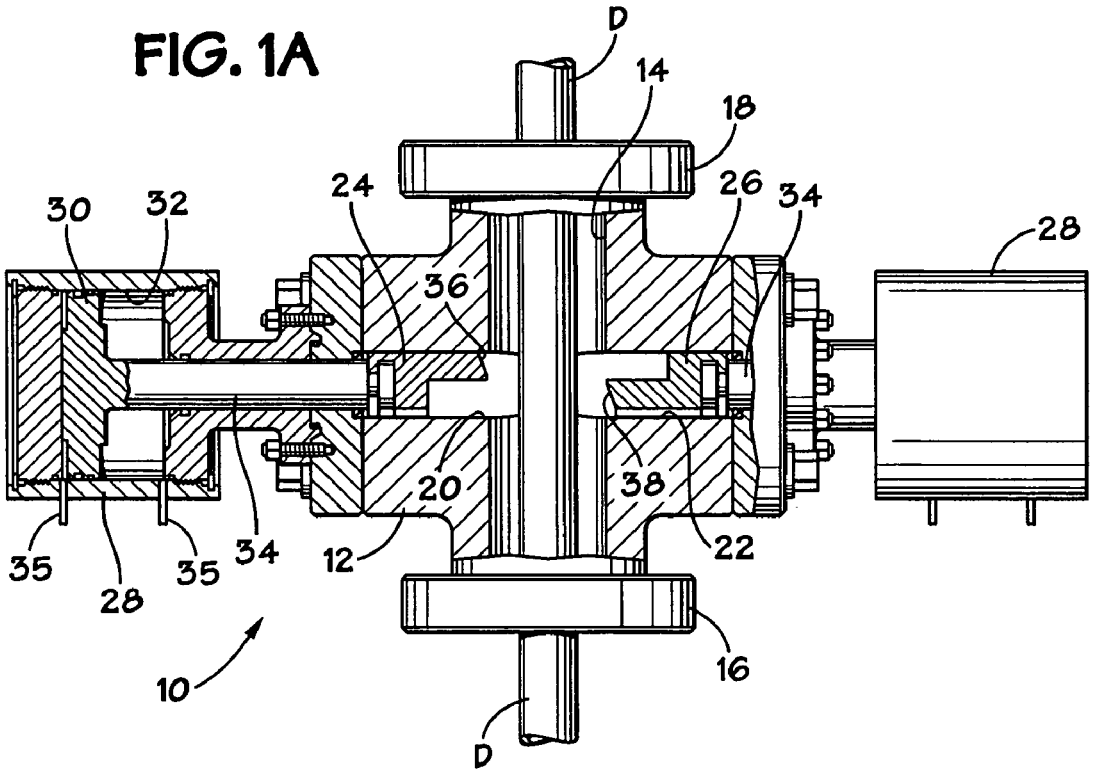
FIG. 1A is a side view, partially in cross-section, of a blowout preventer according to the present invention.
Figure 1B:
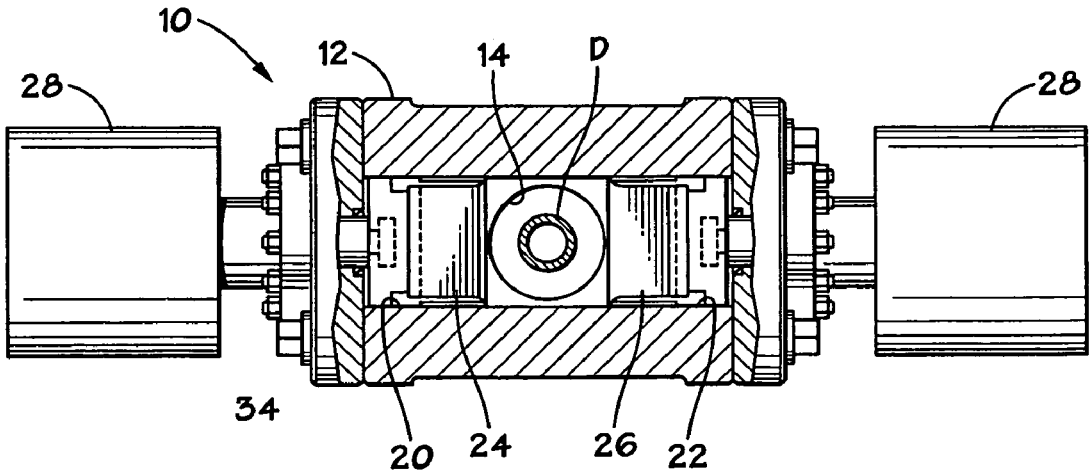
FIG. 1B is a top view of the blowout preventer of FIG. 1A.
Figure 1C:
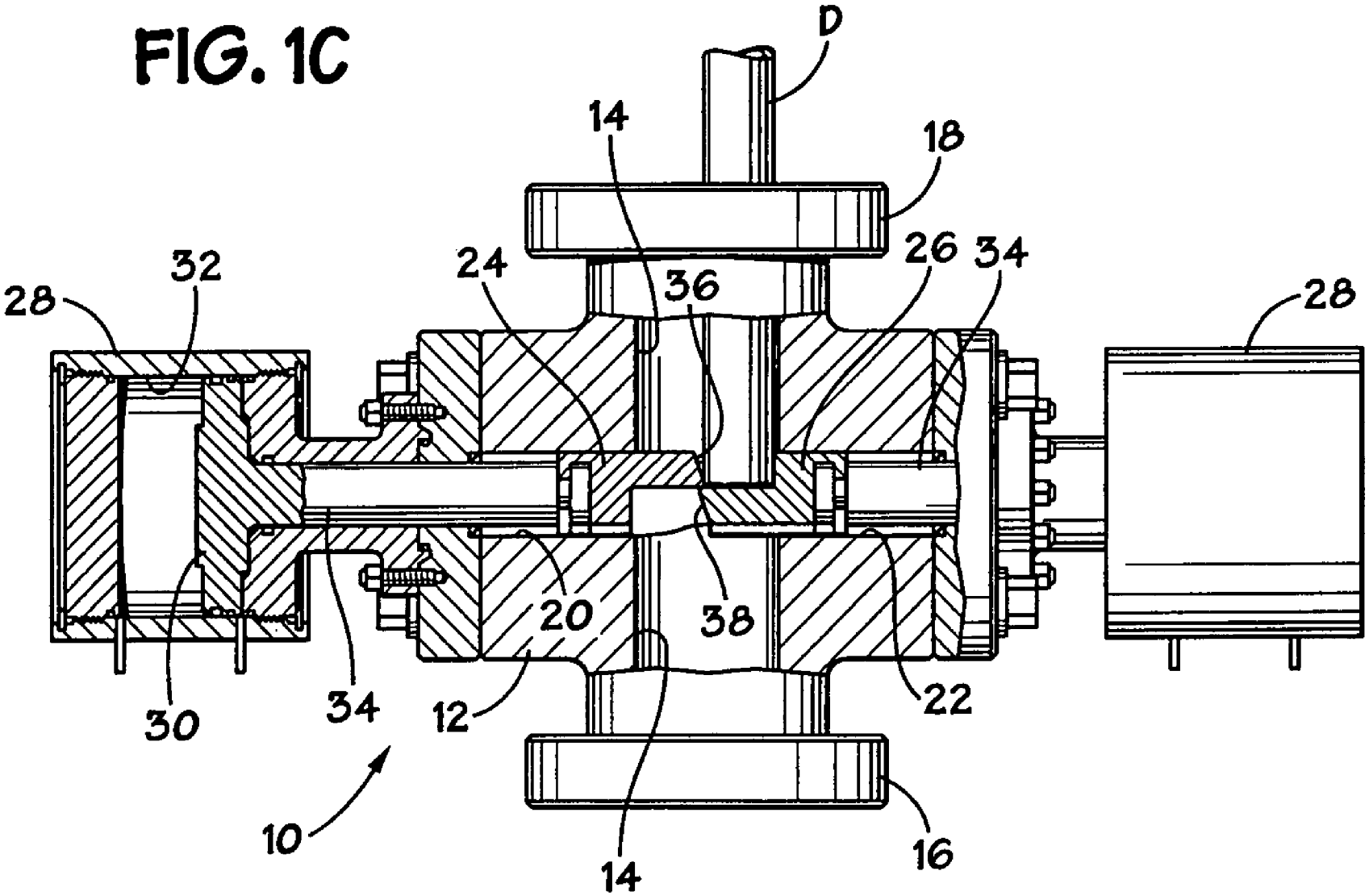
FIG. 1C is a side view, partially in cross-section, of the blowout preventer of FIG. 1A.
Figure 3C:
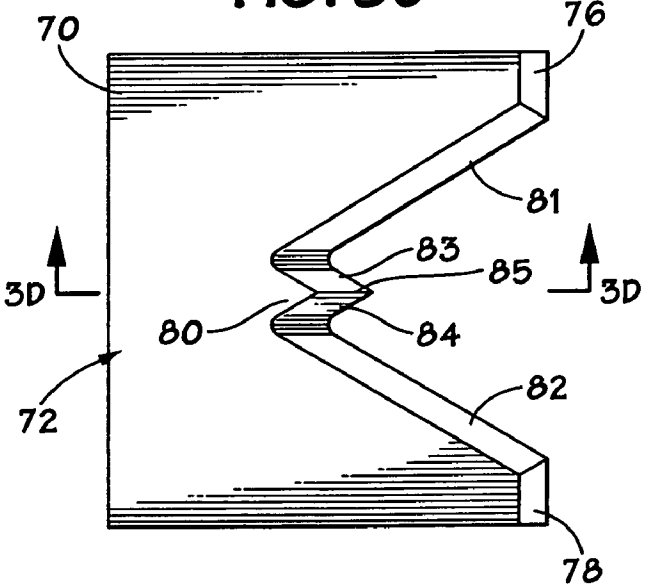
FIG. 3C is a top view of the blade of FIG. 3A.
Figure 3D:
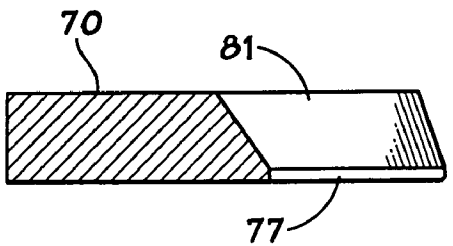
FIG. 3D is a cross-section view along line 3D-3D of FIG. 3A.
Figure 3A:
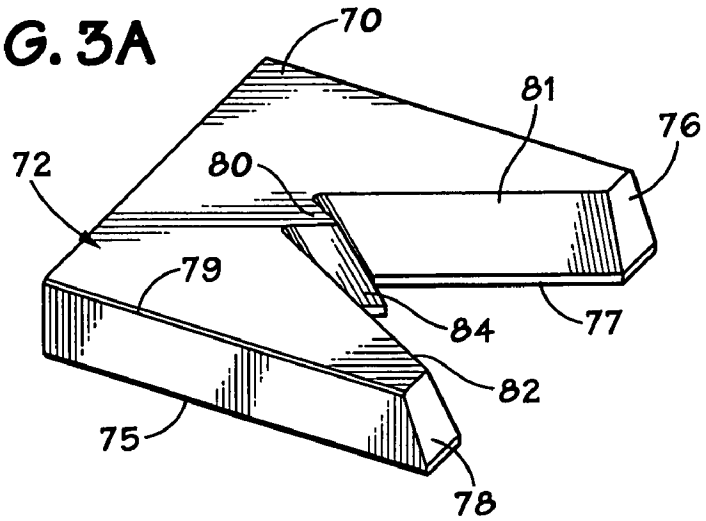
FIG. 3A is a top perspective view of a blade according to the present invention for a blowout preventer according to the present invention.
Figure 3B:
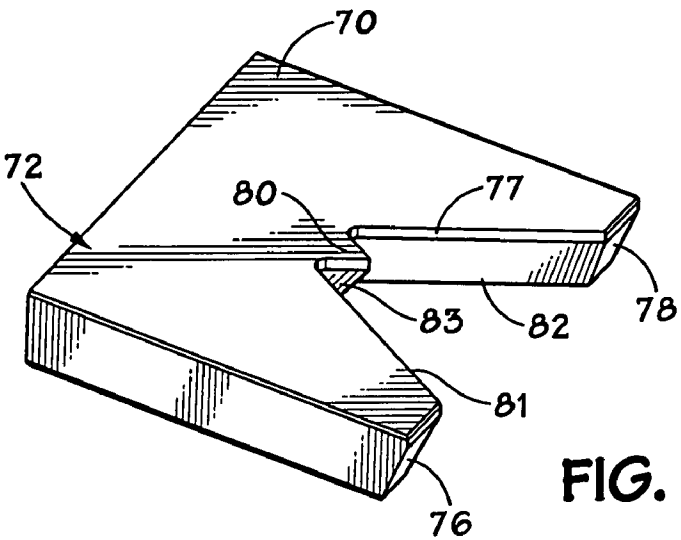
FIG. 3B is a bottom perspective view of the blade of FIG. 3A.
Figure 8C:
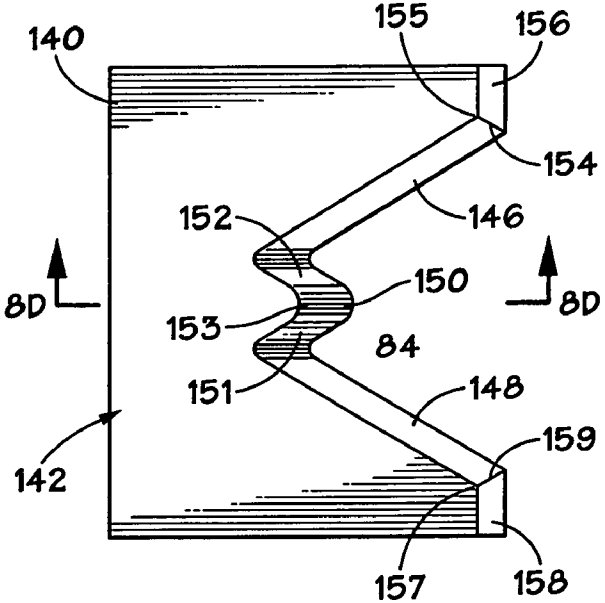
FIG. 8C is a top view of the blade of FIG. 8A.
Figure 8D:
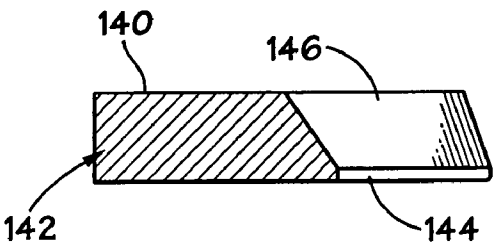
FIG. 8D is a cross-section view along line 8D-8D of FIG. 8A.
Figure 8A:
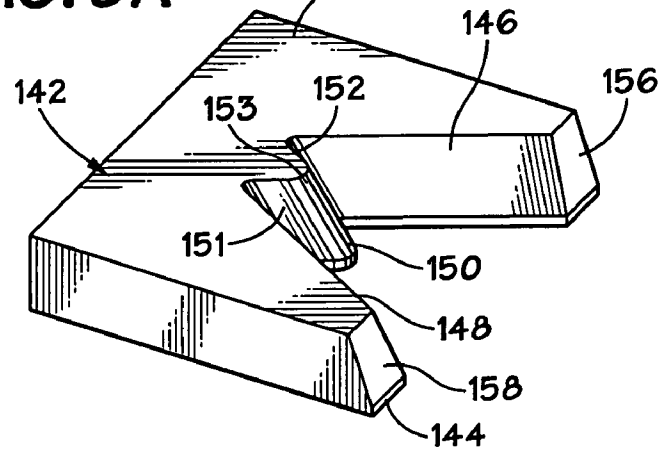
FIG. 8A is a top perspective view of a blade according to the present invention for a blowout preventer according to the present invention.
Figure 8B:
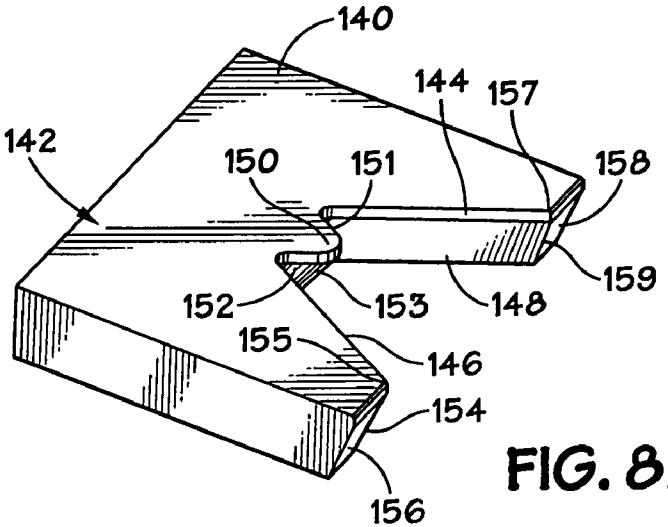
FIG. 8B is a bottom perspective view of the blade of FIG. 8A.

As shown in FIGS. 1A-1C, a blowout preventer 10 according to the present invention has a body 12 with a vertical bore 14 extending therethrough. A tubular, e.g. part of a drill string D passes through the bore 14. The body 12 has a lower flange 16 and an upper flange 18 for connecting the blowout preventer 10 in a wellhead stack. Ram guideways 20 and 22 extend outwardly from opposite sides of the bore 14. Ram assemblies of the blowout preventer 10 include first and second rams 24 and 26 which are positioned in guideways 20 and 22, respectively. Reciprocating apparatus, such as actuators 28, are provided to move or extend the rams in response to fluid pressure into the bore 14 for shearing the portion of the drill string D which extends through the bore and for retracting the rams from the bore. The actuators 28 each include a piston 30 in a cylinder 32 and a rod 34 connecting between the piston and the ram which it is to move and are suitably connected to body 12 as shown. Suitable apparatus is provided to deliver fluid under pressure to opposite sides of piston 30.

An upper cutting blade 36 (any blade according to the present invention) is on the ram 24 and a lower cutting blade 38 (any blade according to the present invention) is on the ram 26. The cutting blades 36 and 38 are positioned so that the cutting edge of the blade 38 passes just below the cutting edge of the blade 36 in shearing of a section of a tubular, e.g. the drillstring D.

The shearing action of cutting blades 36 and 38 shears the drillstring D (see FIG. 1C). The lower portion of the drillstring D has dropped into the well bore (not shown) below the blowout preventer 10. Optionally (as is true for any method according to the present invention) the drillstring TD is hung off a lower set of rams.

FIGS. 2A-2D show a blade 50 according to the present invention which has a body 52 with a base 57 and a front face 54. The front face 54 has two inclined portions 61, 62 and a projection 60 that projects from the front face 54 between the two inclined portions 61, 62. Edges 56, 58 are at ends of the inclined portions 61, 62, respectively. The projection 60 has two inclined faces 63, 64 which meet at a central edge 65. An angle 68 between the faces 63, 64 (as may be true for the angle between any two projection faces according to the present invention) may be any desired angle and, in certain aspects, ranges between 30 degrees to ninety degrees and, in certain particular aspects, is 30 degrees, 60 degrees, or 90 degrees.

In certain aspects (as is true for any blade according to the present invention) the cutting surfaces are slopped from the vertical and in one particular aspect, as shown in FIG. 2D, the two inclined portions 61, 62 are at an angle of 20 degrees from the vertical. In other aspects the angle for any cutting surface of any blade according to the present invention ranges between 20 degrees and 60 degrees; and, in certain aspects, the angle is 20 degrees, 45 degrees, or 60 degrees. degrees.

FIGS. 3A-3D show a blade 70 according to the present invention which has a body 72 with a base 77, two opposed inclined faces 81, 82 and a projection 80 between the two inclined faces 81, 82. The projection 80 has two inclined faces 83, 84 which meet at a central edge 85. Inclined end portions 76, 78 are at ends of the faces 81, 82 respectively.

FIGS. 4A-4D show a blade 90 according to the present invention with a body 99; opposed inclined faces 91, 92; opposed inclined faces 93, 94; and inclined end portions 95, 96. Projections 97, 98 are formed between faces 91, 93 and 94, 92, respectively. The blade 90 has a base 90*a*.

FIGS. 5A-5D show a blade 100 according to the present invention with a body 100*a*; opposed inclined faces 101, 102; opposed inclined faces 103, 104; and opposed inclined end portions 105, 106. Projections 107, 108 are formed between faces 101, 103 and 104, 102, respectively. The blade 100 has a base 109. Projection 107 has an edge 107*a* and projection 108 has an edge 108*a*.

FIGS. 6A-6D show a blade 110 according to the present invention with a body 110*a*, two inclined faces 111, 112; two opposed inclined faces 113, 114; inclined end portions 115, 116; a central semicircular inclined face 117; and a base 110*b*. Projections 118, 119 are formed between faces 111, 113 and 114, 112, respectively. Projection 118 has an edge 118*a* and projection 119 has an edge 119*a*.

FIGS. 7A-7D show a blade 120 according to the present invention which has a body 122; a base 124; opposed inclined faces 126, 128; inclined faces 132, 134; inclined end portions 136, 138; and a semicircular inclined face 130. A serrated cutting surface 125 extends around a lower edge 127 of the face 130 and extends partially onto the faces 126, 128. As shown the serrations of the surface 125 have pointed tips 129; but, optionally, these tips may be rounded off. The faces 126, 132 are at an angle to each other forming a projection 131 with an edge 135. The faces 128, 134 are at an angle to each other forming the projection 133 with an edge 137.

FIGS. 8A-8D show a blade 140 according to the present invention which has a body 142; a base 144; opposed inclined faces 146, 148; a projection 150 between the faces 146, 148; and inclined end portions 156, 158. The projection 150 has inclined faces 151, 152 and a center face 153. A projection 155 is formed between the faces 156, 146 having an edge 154. A projection 157 is formed between the faces 148, 158 having an edge 159. Optionally, as shown, the projection 150 is rounded off.

FIGS. 9A-9D show a blade 160 according to the present invention which has a body 162; a base 164; opposed inclined faces 172, 173; inclined end portions 171, 174; projections 181, 182; and a recess 180 formed between the projections 181, 182. A projection 161 with an edge 163 is formed between the face 172 and the end portion 171. A projection 165 with an edge 167 is formed between the face 173 and the end portion 174. The projection 181 has inclined faces 183, 185 and an inclined center portion 184. The projection 182 has inclined faces 186, 188 and an inclined center portion 187. Optionally, as shown, the projections 181, 182 are rounded off.

Figure 10:
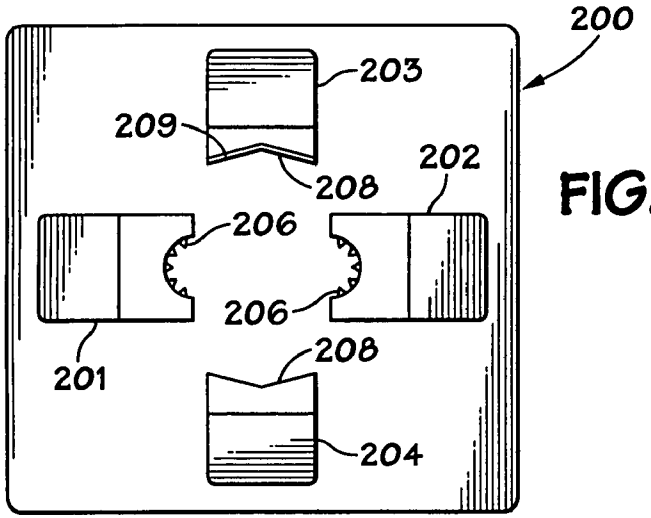
FIG. 10 is a top schematic view of a blowout preventer according to the present invention with blades according to the present invention.

FIG. 10 shows an apparatus 200 for severing a tubular (e.g., but not limited to, drill pipe, drill collar, casing, riser, tubing, and drill pipe tool joints—as is true and can be accomplished with any apparatus herein according to the present invention and with any blade or blades according to the present invention). The apparatus 200 has two alternately movable sets of rams 201, 202 and 203, 204. In one aspect, each ram 201, 202 has a plurality of spaced-apart puncturing points 206 which make a series of corresponding spaced-apart holes in a tubular, thereby weakening the tubular and facilitating its complete shearing by blades 208 (any according to the present invention or any known blade) of the rams 203, 204. In certain aspects, there are one, two, three, four, five, six or more points and, optionally, the points may be hardfaced or have hardening material applied thereto (as is true of any blade, blade projection, or blade part disclosed herein according to the present invention regarding hardfacing and/or hardening material). Any such point or points may be used on any blade according to the present invention and/or the blades may be deleted.

Figure 11:
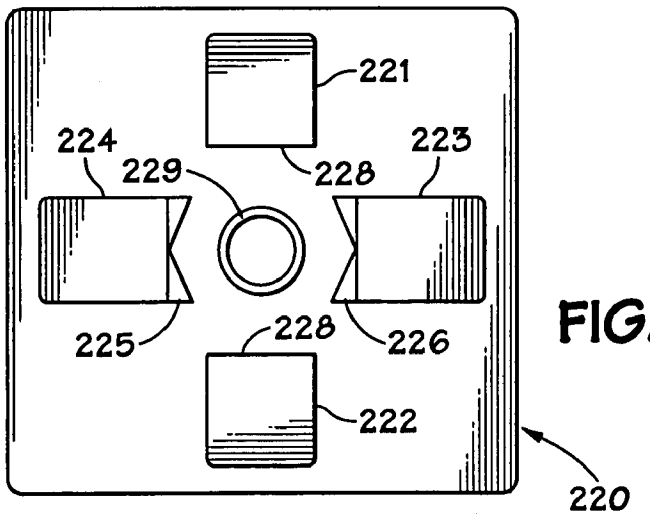
FIG. 11 is a top schematic view of a blowout preventer according to the present invention with blades according to the present invention.

FIG. 11 shows an apparatus 220 according to the present invention which has two sets of movable rams 221, 222 and 223, 224. Rams 221, 222 have flat faces 228 which are used to flatten a tubular 229 ("flatten" means make non-round to any extent as compared to the original round shape of the tubular 229 and includes, but it not limited to, a substantially or totally flattened tubular), e.g. as shown by the dotted line in FIG. 11. Once flattened, the tubular 229 is completely severed by blades 225, 226 on the rams 223, 224, respectively. The blades 225, 226 may be any blade according to the present invention or any known blade.

Figure 12:
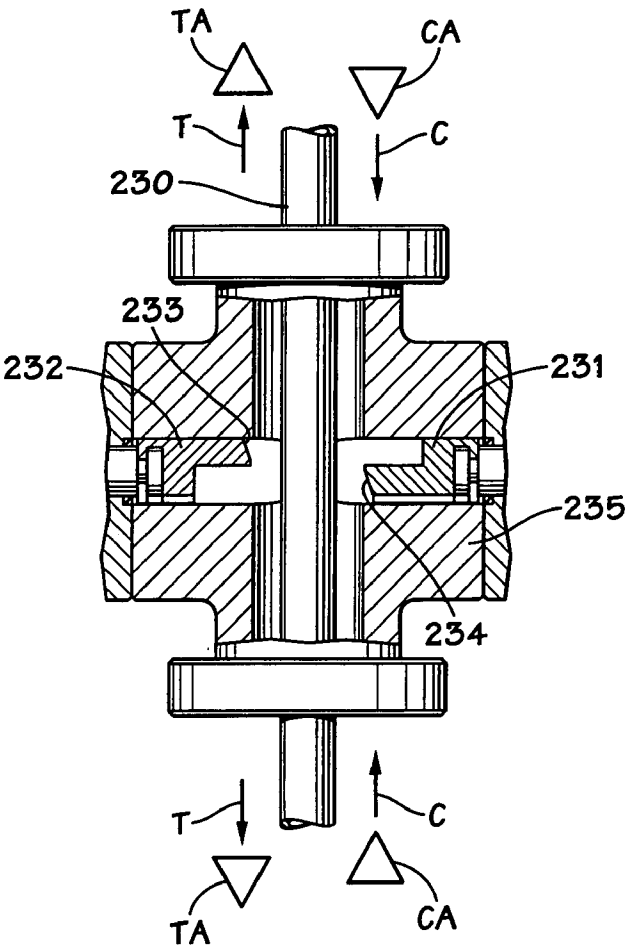
FIG. 12 is a side schematic view of a blowout preventer according to the present invention with blades according to the present invention.

FIG. 12 illustrates a method for severing a tubular 230 by either applying tension T to the tubular lengthwise with a tension applying apparatus TA, shown schematically (see arrows T) or by applying compression to it with a compression applying apparatus CA shown schematically (see arrows C). Ram apparatuses 231, 232 with blades 233, 234 respectively of a blowout preventer 235 are movable to sever the tubular 230.

Optionally, in a two-stroke (or multiple stroke operation) the tubular 230 is put in tension and the blades 233, 234 impact the tubular; then the tubular is put in compression and the blades 233, 234 then completely sever the tubular; or vice-versa. A tensioning step or steps and/or a compression step or steps may be used with any method according to the present invention, including but not limited to, methods as illustrated in FIGS. 10-15.

Figure 13:
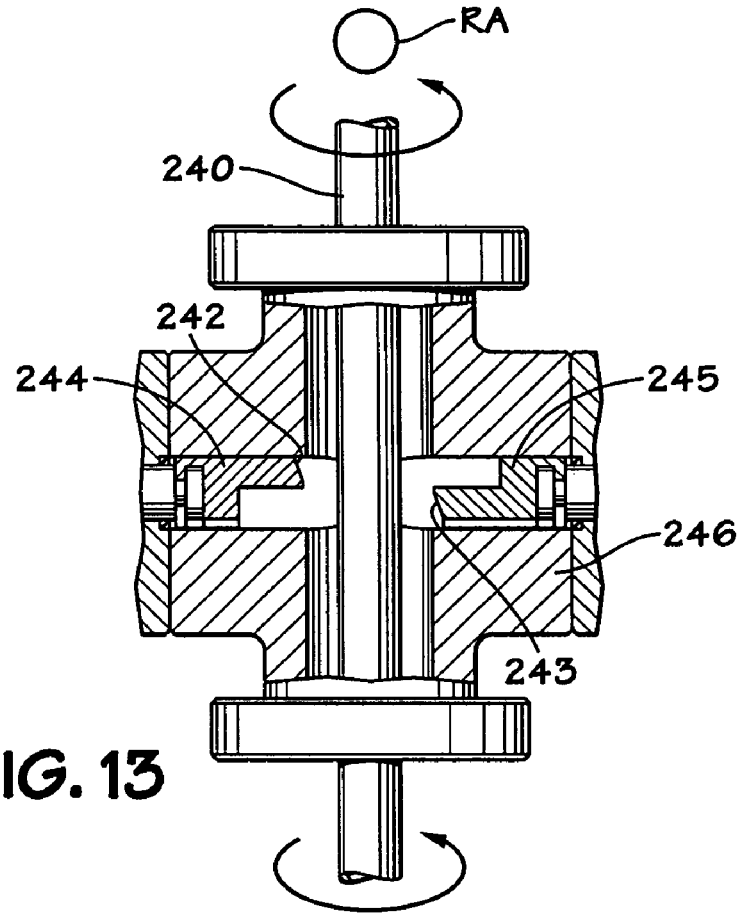
FIG. 13 is a side schematic view of a blowout preventer according to the present invention with blades according to the present invention.

FIG. 13 illustrates a method according to the present invention in which torque is applied to a tubular 240 while it is severed with blades 242, 243 (any blade or blades according to the present invention) of movable ram apparatuses 244, 245 of a blowout preventer 246. Rotation of the tubular 240 can be accomplished by any suitable rotating apparatus above, adjacent, and/or below the tubular, e.g. an apparatus RA (shown schematically in FIG. 13). A torquing step or steps may be used with any method according to the present invention.

Figure 14:
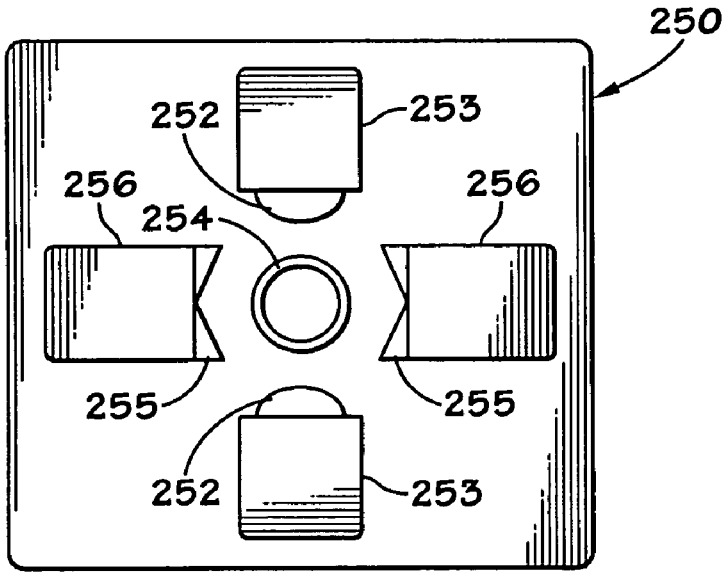
FIG. 14 is a side schematic view of a blowout preventer according to the present invention with blades according to the present invention.

FIG. 14 illustrates a method according to the present invention for either severing a tubular 254 with blades 255 on movable rams 256 within a blowout preventer apparatus 250 using controlled explosive charges 252 in or on movable bodies 253; or a method for weakening a tubular at specific desired locations to facilitate complete severing of the tubular by blade(s) according to the present invention. Optionally, the charges 252 are mounted on the blades 255 or on the rams 256. One, two, three, four or more charges may be used. Any blade according to the present invention or any known blades may be used.

FIGS. 15A-15H illustrate a method according to the present invention using a blowout preventer 300 (depicted schematically, FIG. 15B) according to the present invention (e.g. as any disclosed herein) with movable rams R (shown schematically, FIG. 15B) with blades 301, 302 (blade 301 like blade 302; blade 302 inverted with respect to blade 301—as may be the case with any two blades of any apparatus disclosed herein). Each blade 301, 302 has a body 304 and a central projection 310 with a pointed member 312 and cutting portions 313, 314. Each projection 310 has cutting surfaces 310*a* and 310*b*. The cutting surfaces are sloped from the vertical and the projections 310 have cutting surfaces at an angle to each other. The rams R move the blades so that, initially, the projections 310 contact and puncture a tubular T (e.g. casing, drill pipe, tool joints, drill collars, etc.) and then, following movement of the projections into the tubular T and cutting of the tubular T by the projections 310 and the cutting portions 313, 314, complete severing of the tubular T. The projections 310 are diametrically opposed so that the outermost point of the projections (and then the remainder of the projections) push against each other facilitating puncturing of the tubular and then severing of the tubular. This use of dual opposed puncturing projections also serves to maintain the tubular is a desired location within the blowout preventer 300 during severing so that puncturing and severing proceed with the blades 301, 302 maintained in a desired relation with respect to the tubular T.

Figure 15B:
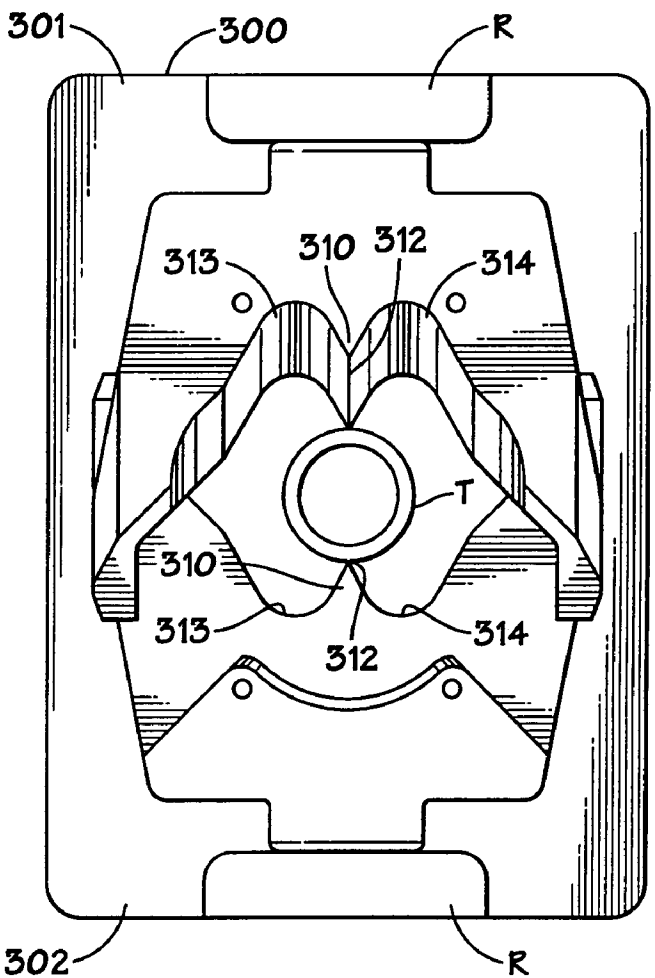
FIG. 15B is a top view that illustrates a step in a method according to the present invention using apparatus according to the present invention.
Figure 15A:
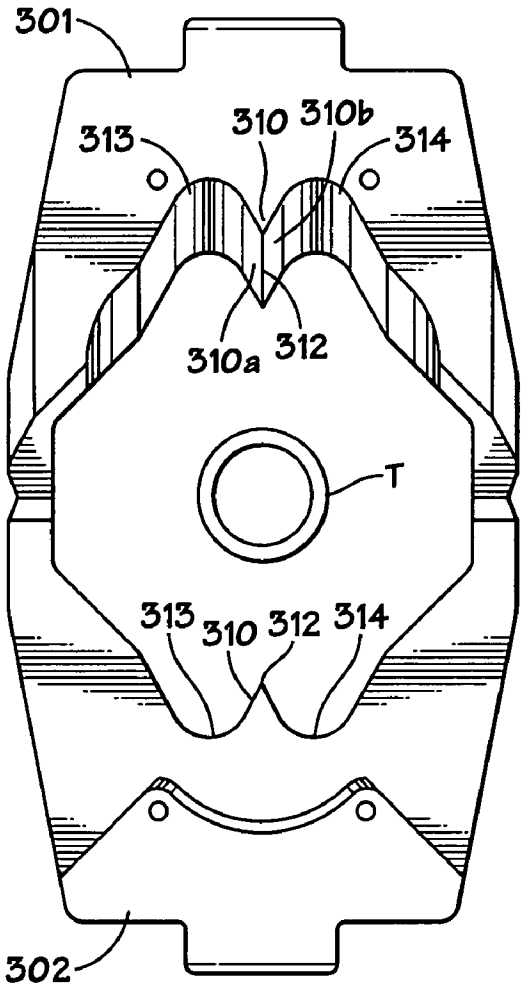
FIG. 15A is a top view that illustrates a step in a method according to the present invention using apparatus according to the present invention.

As shown in FIG. 15B, the points 312 of the projections 310 have moved to contact the outer surface of the tubular T. Upon contact, the points 312 hold the tubular in position. FIG. 15C illustrates initial entry of the points 312 into the tubular T.

As shown in FIG. 15D, the points 312 have penetrated the entire wall thickness of the tubular T and are pushing apart portions T1, T2, and T3, T4. FIG. 15E illustrates further inward progress of the points 312 and further separation of the tubular portions T1, T2 and T3, T4.

As shown in FIG. 15F, as the points 312 progress inwardly and the bottom point 312 (as viewed in FIG. 15F) moves beneath the top point 312, the cutting surfaces 313 and 314 begin to cut the tubular T. The projections 310 cut an amount of the tubular T and the cutting surfaces 313, 314 (and the projections 310 as they progress through the tubular) need cut only the remaining portion of the tubular T to effect complete severing of the tubular T. In certain aspects, and depending on the size of the tubular, the projections 310 can cut the entire tubular.

As shown in FIG. 15G the tubular T is almost completely severed and the top projection 310 has continued to move above the bottom projection 310 as each projection's further piercing of the tubular and the surfaces 313, 314 have continued to further push apart the tubular portions T1, T2, and the portions T3, T4. FIG. 15H shows the tubular T completely severed.

Optionally, only one blade 301 or 302 is used and the other blade has no projection or projections.

As shown in the various drawing figures (e.g. FIGS. 1A, 12, 13, 15A), in some aspects, it is preferred that one blade be inverted with respect to an opposite blade. When a blade with a central projection (or two such blades) are used, cutting surfaces adjacent a cutting projection either cut no tubular at all or only need cut only a fraction of a total wall thickness, circumference of a tubular (unlike, e.g., certain prior "V shear" or "V-shaped" blades in which each cutting surface cuts a much large portion of a tubular).

It is within the scope of the present invention to coat any blade according to the present invention (or any prior blade) or part thereof, and/or cutting surfaces thereof, and/or top and/or bottom thereof, and/or a tubular-puncturing part thereof with a low friction coating, e.g., but not limited to, polytetrafluoroethylene coating, electroless nickel coating, and/or titanium/nickel coating, including but not limited to, low friction coatings applied by a physical vapor deposition ("PVD") process. Such coatings are shown, e.g., as a coating 69 (FIG. 2A) and a coating 209 (FIG. 10) and as a coating 79 (FIG. 3A) on the top of a blade and as a coating 75 (FIG. 3A) on the bottom of a blade, applied by any suitable method or process. These coatings may be applied to any suitable known thickness for the application of low friction coatings.

The present invention, therefore, provides in some, but not in necessarily all, embodiments a blowout preventer with a body with a top, a bottom, and a bore therethrough from the top to the bottom, ram apparatus movable within the body, the ram apparatus including two ram blocks each with a cutting blade according to the present invention.

The present invention, therefore, provides in at least some embodiments, methods for using a blowout preventer according to the present invention.

The present invention, therefore, provides in certain, but not necessarily all embodiments, a method for severing a tubular, the tubular useful for wellbore operations, the method including inserting a tubular into a tubular severing apparatus (the apparatus including a first member movable toward the tubular, a second member movable toward the tubular to be severed, the second member disposed opposite to the first member, a first blade on the first member, the first blade comprising a first blade body, a first projection projecting from the first blade body, a first point structure on the first projection for contacting and puncturing the tubular, first projection cutting surfaces on the first projection defining the first point structure and for cutting the tubular, and the first point structure projecting sufficiently from the first blade body so that the first projection can contact the tubular and puncture the tubular before any other part of the first blade body contacts the tubular, and a second blade on the second member); moving the first blade toward the tubular to bring the first point structure into contact with an outer surface of the tubular; moving the first blade so that the first point structure punctures into the tubular and goes through the tubular; moving the first blade to cut a portion of the tubular with the first projection cutting surfaces; and severing the tubular by moving the first blade and the second blade toward each other. Such a method may include one or some, in any possible combination, of the following: wherein the tubular severing apparatus's second blade has a second blade body, a second projection projecting from the second blade body, a second point structure on the second projection for contacting and puncturing the tubular, second projection cutting surfaces on the second projection defining the point structure and for cutting the tubular, and the second point structure projecting sufficiently from the second blade body so that the second projection can contact the tubular and puncture the tubular before any other part of the second blade body contacts the tubular, the method including moving the second blade toward the tubular as the first blade is moved toward the tubular and moving the second blade so that the second point structure contacts an outer surface of the tubular, moving the second blade so that the second point structure punctures into the tubular and goes through the tubular, and moving the second blade to cut a portion of the tubular with the second projection cutting surfaces; wherein the tubular is severed by the projection cutting surfaces of the first blade and of the second blade; wherein the first blade further comprises first blade cutting surfaces adjacent the first projection, and the second blade comprises second blade cutting surfaces adjacent the second projection, the method including moving the first blade and the second blade so that each blade's blade cutting surfaces cut a portion of the tubular; wherein the first point structure is rounded off; wherein the second point structure is rounded off; wherein the first projection, the first blade cutting surfaces, the second projection, and the second blade cutting surfaces are coated with a low friction coating; wherein the first blade has a top and a bottom and the second blade has a top and a bottom and the tops and bottoms of the two blades are coated with a low friction coating; wherein the first projection is disposed above and opposite the second projection; wherein each of the two point structures contact the tubular substantially simultaneously and puncture the tubular substantially simultaneously; during severing of the tubular, tensioning the tubular with tension apparatus; during severing of the tubular, compressing the tubular with compression apparatus; during severing of the tubular, rotating the tubular with rotating apparatus; prior to any contact between the tubular and either of the blades, flattening the tubular with flattening apparatus; wherein the first blade has a first top and a first bottom, the second blade has a second top and a second bottom, the first projection cutting surfaces slope down from the first top to the first bottom, and the second projection cutting surfaces slope down from the second top to the second bottom; wherein the second blade is inverted with respect to the first blade; wherein the projection cutting surfaces of each blade are at an angle to each other ranging between 30 degrees and 90 degrees; and/or wherein the tubular is from the group consisting of casing, drill pipe, drill collar, and tool joint.

The present invention, therefore, provides in certain, but not necessarily all embodiments, a method for severing a tubular, the tubular useful for wellbore operations, the method including: inserting a tubular into a tubular severing apparatus (the apparatus having a first member movable toward the tubular, a second member movable toward the tubular to be severed, the second member disposed opposite to the first member, a first blade on the first member, the first blade comprising a first blade body, a first projection projecting from the first blade body, a first point structure on the first projection for contacting and puncturing the tubular, first projection cutting surfaces on the first projection defining the first point structure and for cutting the tubular, and the first point structure projecting sufficiently from the first blade body so that the first projection can contact the tubular and puncture the tubular before any other part of the first blade body contacts the tubular, and a second blade on the second member); moving the first blade toward the tubular to bring the first point structure into contact with an outer surface of the tubular; moving the first blade so that the first point structure punctures into the tubular and goes through the tubular; moving the first blade to cut a portion of the tubular with the first projection cutting surfaces; severing the tubular by moving the first blade and the second blade toward each other; wherein in the tubular severing apparatus the second blade has a second blade body, a second projection projecting from the second blade body, a second point structure on the second projection for contacting and puncturing the tubular, second projection cutting surfaces on the second projection defining the point structure and for cutting the tubular, and the second point structure projecting sufficiently from the second blade body so that the second projection can contact the tubular and puncture the tubular before any other part of the second blade body contacts the tubular; moving the second blade toward the tubular as the first blade is moved toward the tubular and moving the second blade so that the second point structure contacts an outer surface of the tubular; moving the second blade so that the second point structure punctures into the tubular and goes through the tubular; moving the second blade to cut a portion of the tubular with the second projection cutting surfaces; wherein the first projection is disposed above and opposite the second projection; wherein each of the two point structures contact the tubular substantially simultaneously and puncture the tubular substantially simultaneously; and wherein the second blade is inverted with respect to the first blade.

The present invention, therefore, provides in certain, but not necessarily all embodiments, a tubular severing apparatus for severing a tubular used in wellbore operations, the apparatus including: a first member movable toward a tubular to be severed, the tubular comprising a wellbore operations tubular; a second member movable toward the tubular to be severed, the second member disposed opposite to the first member; a first blade on the first member, the first blade including a blade body, a projection projecting from a center of the blade body, point structure on the projection for contacting and puncturing the tubular, projection cutting surfaces on the projection defining the point structure and for cutting the tubular, and the point structure projecting sufficiently from the blade body and the projection movable to contact the tubular and puncture the tubular before any other part of the blade body contacts the tubular; and, in one aspect, the second blade like the first blade.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. U.S. application Ser. No. 11/411,203 filed Apr. 25, 2006 and U.S. Pat. No. 7,367,396 issued on May 6, 2008 are both incorporated fully herein for all purposes.

What is claimed is:

1. A method for severing a tubular, the tubular useful for wellbore operations, the method comprising inserting a portion of a tubular into a tubular severing apparatus comprising a first member movable toward the tubular, a second member movable toward the tubular, the second member disposed opposite the first member, a first blade on the first member, the first blade comprising a first blade body, a first point structure on the first blade body for contacting and puncturing the tubular, first cutting surfaces on the first blade body spaced-apart and adjacent the first point structure and for cutting the tubular, the first point structure projecting sufficiently from the first blade body so that the first point structure can contact the tubular and puncture the tubular before the first cutting surfaces of the first blade body cut the tubular, and a second blade on the second member, the second blade comprising a second blade body, a second point structure on the second blade body for contacting and puncturing the tubular, second cutting surfaces on the second blade body spaced-apart and adjacent the second point structure and for cutting the tubular, the second point structure projecting sufficiently from the second blade body so that the second point structure can contact the tubular and puncture the tubular before the second cutting surfaces of the second blade body cut the tubular, moving the first blade toward the tubular to bring the first point structure into contact with an outer surface of the tubular, moving the first blade so that the first point structure punctures into the tubular and goes through the tubular, moving the second blade toward the tubular to bring the second point structure into contact with an outer surface of the tubular, moving the second blade so that the second point structure punctures into the tubular and goes through the tubular, wherein each of the two point structures contact the tubular substantially simultaneously and puncture the tubular substantially simultaneously, following puncturing of the tubular by the point structures, pushing apart portions of the tubular adjacent each point structure as the point structures move toward each other, following puncturing of the tubular by both point structures, moving the first blade and the second blade to sever the tubular with the first and second cutting surfaces, wherein each point structure has a point and each point passes completely through the tubular prior to complete severing of the tubular.

2. The method of claim 1 wherein the tubular is from the group consisting of casing, drill pipe, drill collar, and tool joint.

3. The method of claim 1 wherein the first point structure is above the second point structure.

4. A method for severing a tubular, the tubular useful for wellbore operations, the method comprising inserting a portion of a tubular into a tubular severing apparatus comprising a first member movable toward the tubular, a second member movable toward the tubular, the second member disposed opposite the first member, a first blade on the first member, the first blade comprising a first blade body, a first point structure on the first blade body for contacting and puncturing the tubular, first cutting surfaces on the first blade body spaced-apart and adjacent the first point structure and for cutting the tubular, the first point structure projecting sufficiently from the first blade body so that the first point structure can contact the tubular and puncture the tubular before the first cutting surfaces of the first blade body cut the tubular, and a second blade on the second member, the second blade comprising a second blade body, a second point structure on the second blade body for contacting and puncturing the tubular, second cutting surfaces on the second blade body spaced-apart and adjacent the second point structure and for cutting the tubular, the second point structure projecting sufficiently from the second blade body so that the second point structure can contact the tubular and puncture the tubular before the second cutting surfaces of the second blade body cut the tubular, moving the first blade toward the tubular to bring the first point structure into contact with an outer surface of the tubular, moving the first blade so that the first point structure punctures into the tubular and goes through the tubular, moving the second blade toward the tubular to bring the second point structure into contact with an outer surface of the tubular, moving the second blade so that the second point structure punctures into the tubular and goes through the tubular, following puncturing of the tubular by both point structures, moving the first blade and the second blade to sever the tubular with the first and second cutting surfaces following puncturing of the tubular by the point structures, pushing apart portions of the tubular adjacent each point structure as the point structures move toward each other, and said pushing apart occurring before cutting of the tubular by the first cutting surfaces and by the second cutting surfaces.

5. The method of claim 4 wherein each of the two point structures contact the tubular substantially simultaneously and puncture the tubular substantially simultaneously.

6. The method of claim 4 wherein the tubular is from the group consisting of casing, drill pipe, drill collar, and tool joint.

7. The method of claim 4 further comprising severing the tubular with the cutting surfaces occurs after said pushing apart.

8. The method of claim 4 wherein each point structure has a point and each point passes completely through the tubular prior to severing of the tubular by the cutting surfaces.

9. The method of claim 4 wherein the first point structure is above the second point structure.

10. A tubular severing apparatus for severing a tubular used in wellbore operations, the tubular severing apparatus comprising a first member movable toward the tubular, a second member movable toward the tubular, the second member disposed opposite the first member, a first blade on the first member, the first blade comprising a first blade body, a first point structure on the first blade body for contacting and puncturing the tubular, first cutting surfaces on the first blade body spaced-apart and adjacent the first point structure and for cutting the tubular, the first point structure projecting sufficiently from the first blade body so that the first point structure can contact the tubular and puncture the tubular before the first cutting surfaces of the first blade body cut the tubular, the second member having a second blade comprising a second blade body, a second point structure on the second blade body for contacting and puncturing the tubular, second cutting surfaces on the second blade body spaced-apart and adjacent the second point structure and for cutting the tubular, the second point structure projecting sufficiently from the second blade body so that the second point structure can contact the tubular and puncture the tubular before the second cutting surfaces of the second blade body cut the tubular, the first cutting surfaces and the second cutting surfaces positioned so that following puncturing of the tubular by both point structures, the cutting surfaces are movable to sever the tubular, and the cutting surfaces positioned and configured for pushing apart portions of the tubular adjacent each point structure as the point structures are moved toward each other.

11. The tubular severing apparatus of claim 10 wherein each of the two point structures are movable to contact a tubular substantially simultaneously and puncture the tubular substantially simultaneously.

12. The tubular severing apparatus of claim 10 wherein each point structure has a point and each point can pass completely through the tubular prior to complete severing of the tubular.

13. The tubular severing apparatus of claim 10 wherein the first point structure is above the second point structure.

* * * * *